US008222877B2

(12) United States Patent
Cerchi et al.

(10) Patent No.: US 8,222,877 B2
(45) Date of Patent: Jul. 17, 2012

(54) VOLTAGE REGULATOR AND METHOD FOR VOLTAGE REGULATION

(75) Inventors: Marco Cerchi, Cornale (IT); Carlo Fiocchi, Belgioioso (IT)

(73) Assignee: austriamicrosystems AG, Unterpremstätten (AT)

( * ) Notice: Subject to any disclaimer, the term of this patent is extended or adjusted under 35 U.S.C. 154(b) by 358 days.

(21) Appl. No.: 12/523,510

(22) PCT Filed: Jan. 16, 2008

(86) PCT No.: PCT/EP2008/050465

§ 371 (c)(1),
(2), (4) Date: Jan. 29, 2010

(87) PCT Pub. No.: WO2008/087165

PCT Pub. Date: Jul. 24, 2008

(65) Prior Publication Data

US 2010/0164451 A1 Jul. 1, 2010

(30) Foreign Application Priority Data

Jan. 17, 2007 (EP) ..... 07000924

(51) Int. Cl.
*G05F 1/44* (2006.01)

(52) U.S. Cl. ..... 323/282

(58) Field of Classification Search ..... 323/268, 323/273, 274, 280–284, 351
See application file for complete search history.

(56) References Cited

U.S. PATENT DOCUMENTS

| | | | | |
|---|---|---|---|---|
| 5,392,000 | A | 2/1995 | Gillig | |
| 5,631,598 | A | 5/1997 | Miranda et al. | |
| 6,201,375 | B1 * | 3/2001 | Larson et al. | 323/277 |
| 6,300,749 | B1 * | 10/2001 | Castelli et al. | 323/273 |
| 6,975,099 | B2 * | 12/2005 | Wu et al. | 323/280 |
| 7,253,595 | B2 * | 8/2007 | Oddoart et al. | 323/274 |
| 7,714,551 | B2 * | 5/2010 | Fan et al. | 323/273 |
| 7,855,602 | B2 * | 12/2010 | Fiocchi et al. | 330/292 |
| 2003/0111986 | A1 | 6/2003 | Xi | |
| 2003/0224624 | A1 | 12/2003 | Gay | |
| 2004/0061485 | A1 | 4/2004 | Hamon et al. | |
| 2004/0130397 | A1 | 7/2004 | Mactaggart | |

FOREIGN PATENT DOCUMENTS

| | | |
|---|---|---|
| EP | 0 531 945 | 9/1992 |
| EP | 1 569 062 | 8/2005 |
| WO | WO 2004/015512 | 2/2004 |

OTHER PUBLICATIONS

A. G. Rincon-Mora et al., "A Low-Voltage, Low Quiescent Current, Low Drop-Out Regulator", IEEE Journal of Solid-State Circuits, vol. 33, No. 1, Jan. 1998.

* cited by examiner

*Primary Examiner* — Adolf Berhane
(74) *Attorney, Agent, or Firm* — Cozen O'Connor

(57) ABSTRACT

A voltage regulator, comprising: an input terminal; an output terminal at which an output voltage is provided; an output transistor which couples the input terminal of the voltage regulator to the output terminal of the voltage regulator; and a transimpedance amplifier including an input terminal which is coupled to the output terminal of the voltage regulator and an output terminal which is coupled to a control terminal of the output transistor, optionally via a coupling, the coupling having an impedance value between the output terminal of the transimpedance amplifier and the control terminal of the output transistor which at a given frequency is smaller than or equal to an impedance value of an output impedance of the transimpedance amplifier.

14 Claims, 4 Drawing Sheets

VOLTAGE REGULATOR AND METHOD FOR VOLTAGE REGULATION

RELATED APPLICATIONS

This is a U.S. national stage under 35 USC §371 of application No. PCT/EP2008/050465, filed on Jan. 16, 2008.

This application claims the priority of European Patent Application No. 07000924.6 filed Jan. 17, 2007, the entire content of which is hereby incorporated by reference.

FIELD OF THE INVENTION

The present invention relates to a voltage regulator and a method for voltage regulation.

BACKGROUND OF THE INVENTION

Voltage regulators are widely used for providing an approximately constant output voltage. A voltage regulator often comprises an output transistor which is controlled by a voltage depending on the output voltage of the voltage regulator.

Document G. A. Rincon-Mora, P. E. Allen, "A Low-Voltage, Low Quiescent Current, Low Drop-Out Regulator", IEEE Journal of Solid-State Circuits, volume 33, no. 1, January 1998, pp. 36-44, shows a voltage regulator comprising an output transistor, a voltage divider and an amplifier, wherein the amplifier controls the output transistor depending on the output voltage and a reference voltage.

SUMMARY OF THE INVENTION

It is an object of the present invention to provide a voltage regulator and a method for voltage regulation, achieving an effective control of an output voltage with high stability.

According to an embodiment of the invention, a voltage regulator comprises an input terminal, an output transistor, an output terminal and a transimpedance amplifier. The output transistor is arranged between the input terminal of the voltage regulator and the output terminal of the voltage regulator. The transimpedance amplifier comprises an input terminal and an output terminal. The input terminal of the transimpedance amplifier is coupled to the output terminal of the voltage regulator. The output terminal of the transimpedance amplifier is coupled to a control terminal of the output transistor.

An input voltage is applied to the input terminal of the voltage regulator. The output transistor provides an output voltage at the output terminal of the voltage regulator using the input voltage. A feedback current which depends on the output voltage is provided to the input terminal of the transimpedance amplifier. The transimpedance amplifier amplifies the feedback current and provides a control voltage at the output terminal of the transimpedance amplifier. The control voltage depends on the feedback current and is provided to the control terminal of the output transistor.

The voltage regulator achieves a high cut-off frequency at the control terminal of the output transistor.

It is an advantage of the voltage regulator that the control voltage for the control terminal of the output transistor is provided with low impedance. Even if a capacitance of the control terminal of the output transistor is high, a short time constant for a change of the control voltage at the control terminal is advantageously achieved. This leads to a high stability of the voltage regulator.

In an embodiment, a coupling between the output terminal of the transimpedance amplifier and the control terminal of the output transistor has an impedance value between the output terminal of the transimpedance amplifier and the control terminal of the output transistor which at a given frequency is smaller or equal than an impedance value of an output impedance of the transimpedance amplifier. Thus the control of the output transistor is achieved with a low time constant.

The impedance value of the output impedance of the transimpedance amplifier can be defined as the ratio of a value of an output voltage of the transimpedance amplifier and a value of a current which flows through the output terminal of the transimpedance amplifier to the control terminal of the output transistor. Preferably, the impedance value of the output impedance of the transimpedance amplifier can be defined as the ratio of an AC output voltage of the transimpedance amplifier and of an AC current which flows through the output terminal of the transimpedance amplifier to the control terminal of the output transistor.

In one embodiment, the impedance value of the output impedance of the transimpedance amplifier can be measured by forcing an AC current into the output terminal of the transimpedance amplifier, by measuring an AC voltage at the output terminal of the transimpedance amplifier and by calculating the ratio of the AC voltage to the AC current which results in the impedance value.

In one embodiment, the impedance value of a coupling, such as for example of a connection line, between the output terminal of the transimpedance amplifier and the control terminal of the output transistor can be measured by shorting the output terminal of transimpedance amplifier to the input terminal for applying the input voltage to the output terminal of transimpedance amplifier and by forcing a further AC current to the control terminal of the output transistor. Further on, a further AC voltage is measured at the control terminal of the output transistor and the ratio of the further AC voltage to the further AC current is calculated which results in the impedance value.

In an embodiment, the impedance value of the coupling between the output terminal of the transimpedance amplifier and the control terminal of the output transistor is defined as an absolute value of the impedance. Accordingly the impedance value of the output impedance of the transimpedance amplifier is defined as an absolute value of the output impedance.

In an embodiment, the given frequency has a small value. Preferably the given frequency has a value of 0 Hertz.

A controlled path of the output transistor may be connected between the input terminal and the output terminal of the voltage regulator.

Instead of a coupling between the output terminal of the transimpedance amplifier and the control terminal of the output transistor having an impedance value between the output terminal of the transimpedance amplifier and the control terminal of the output transistor being smaller or equal than an impedance value of the output impedance of the transimpedance amplifier, in other embodiments the output terminal of the transimpedance amplifier is directly connected to the control terminal of the output transistor, or the voltage regulator comprises a coupling impedance which is directly connected on one side to the output terminal of the transimpedance amplifier and on another side to the control terminal of the output transistor, or the voltage regulator comprises a coupling transistor with a controlled section, so that one side of the controlled section is directly connected to the output terminal of the transimpedance amplifier and another side of the controlled section is directly connected to the control terminal of the output transistor, or the voltage regulator comprises a coupling arrangement which is directly connected on one side to the output terminal of the transimpedance amplifier and on another side to the control terminal of the output transistor and wherein the coupling arrangement comprises a series circuit and/or a parallel circuit of at least one coupling impedance and/or at least one controlled section of a coupling transistor.

Instead of a coupling between the output terminal of the transimpedance amplifier and the control terminal of the output transistor having an impedance value between the output terminal of the transimpedance amplifier and the control terminal of the output transistor being smaller than an impedance value of the output impedance of the transimpedance amplifier, in another embodiment the coupling between the output terminal of the transimpedance amplifier and the control terminal of the output transistor has a gain factor which is smaller or equal to a value 1, wherein the value 1 of the gain factor corresponds to 0 dB.

In an embodiment, the voltage regulator can be realized as low-dropout voltage regulator, abbreviated as LDO.

In an embodiment, the output transistor is realized as rechannel field-effect transistor. It is an advantage of the rechannel field-effect transistor that it provides a high conductivity. In an alternative embodiment, the output transistor is realized as p-channel field-effect transistor. It is an advantage of the p-channel field-effect transistor that it can effectively be controlled also if a voltage at the input terminal and a voltage at the output terminal have high positive values.

In a further development, the voltage regulator comprises at least a further output transistor which is coupled in parallel to the output transistor.

The at least one further output transistor is preferably a n-channel field-effect transistor if the output transistor is a n-channel field-effect transistor and is preferably a p-channel field-effect transistor if the output transistor is a p-channel field-effect transistor.

It is an advantage that the input terminal is coupled to the output terminal via the output transistor because this offers a possibility of operating the voltage regulator in such a way that a minimum difference between the input voltage and the output voltage is achieved.

The transimpedance amplifier can be designed in such a way that the control voltage comprises a large voltage span so that the output transistor is able to drive a load current which ranges in several orders of magnitude. The load current may range, for example, from 1 μA to several hundred mA.

In an embodiment, the transimpedance amplifier comprises an amplifier and a first impedance. The first impedance couples the output terminal of the transimpedance amplifier to the input terminal of the transimpedance amplifier. The first impedance provides a resistive path between the output terminal of the transimpedance amplifier and the input terminal of the transimpedance amplifier. An input terminal of the amplifier is coupled to the input terminal of the transimpedance amplifier. An output terminal of the amplifier is coupled to the output terminal of the transimpedance amplifier. The first impedance is arranged between the input terminal of the amplifier and the output terminal of the amplifier. The first impedance provides a feedback from the output terminal to the input terminal of the transimpedance amplifier and may set the gain of the transimpedance amplifier. It advantageously may prevent the loop gain-bandwidth product of the voltage regulator from getting too large.

According to an embodiment, the amplifier comprises a further input terminal which is realized as a non-inverting input terminal. The further input terminal is connected to a voltage source. The input terminal of the amplifier can be designed as an inverting input terminal.

In an embodiment, the output terminal of the amplifier and thus the output terminal of the transimpedance amplifier is directly connected to the control terminal of the output transistor.

In an alternative embodiment, the output terminal of the transimpedance amplifier is coupled to the control terminal of the output transistor via a coupling comprising a coupling impedance and/or a controlled section of a coupling transistor. The coupling is realized in such a way that a resistive path from the output terminal of the transimpedance amplifier to the control terminal of the output transistor is achieved. The coupling between the output terminal of the transimpedance amplifier and the control terminal of the output transistor is designed that the gain factor of the coupling is smaller or equal to a value 1, wherein the value 1 of the gain factor corresponds to 0 dB.

The first impedance may comprise a first resistor. The first impedance additionally comprises a capacitance. In a further development, the first impedance comprises the first resistor, a second resistor and the capacitance which are arranged as a T-circuit.

In a further development, the first resistor and/or the second resistor are realized as thin film resistors. The thin film resistor can comprise polysilicon or a metal as resistive material.

The first impedance may comprise a combination of resistive-capacitive elements which provide the transfer function of the transimpedance amplifier.

In an embodiment, the amplifier comprises a first transistor with a control terminal, a first terminal and a second terminal. The control terminal of the first transistor is connected to the input terminal of the transimpedance amplifier. The first terminal of the first transistor is coupled to the control terminal of the output transistor via the output terminal of the transimpedance amplifier. In an embodiment, the first terminal of the first transistor is directly connected to the control terminal of the output transistor via the output terminal of the transimpedance amplifier. The first terminal of the first transistor may be permanently connected to the control terminal of the output transistor. Alternatively, the first terminal of the first transistor is coupled to the control terminal of the output transistor via the coupling impedance and/or the controlled section of the coupling transistor.

In an embodiment, the amplifier comprises a first current source which is arranged between the first terminal of the first transistor and the reference potential terminal. The first current source may comprise a resistor. The second terminal of the first transistor is connected to the input terminal of the voltage regulator.

In an embodiment, a semiconductor body comprises the output transistor, the voltage divider, the differential amplifier and the transimpedance amplifier. The load capacitor is coupled to the output terminal of the voltage regulator. A load can be connected to the output terminal of the voltage regulator.

In order to achieve a feedback voltage with a lower value than the output voltage, the voltage regulator may comprise a voltage divider which is arranged between the output terminal of the voltage regulator and the reference potential terminal. The voltage divider comprises a first divider resistor and a second divider resistor which are arranged in a series circuit between the output terminal of the voltage regulator and the reference potential terminal. The voltage divider comprises a feedback tap between the first divider resistor and the second divider resistor.

The voltage regulator may alternatively comprise a feedback circuit which comprises a feedback resistor and a feedback current source which are connected between the output terminal of the voltage regulator and a reference potential terminal. The feedback tap is arranged between the feedback resistor and the feedback current source to provide the feedback voltage. It is an advantage of this embodiment that an area on a surface of the semiconductor body is saved, an optimal loop response is provided and a high accuracy is achieved.

In an embodiment, the feedback tap is coupled to the input terminal of the transimpedance amplifier. In a preferred embodiment, the voltage regulator comprises a differential amplifier, which couples the feedback tap of the voltage divider or the feedback tap of the feedback circuit to the input terminal of the transimpedance amplifier.

The voltage regulator can be used for a low power application.

According to an aspect of the invention, a method for voltage regulation comprises applying an input voltage to an output transistor and generating an output voltage by the output transistor. A feedback current is generated as a function of the output voltage. A control voltage is applied to a control terminal of the output transistor. The control voltage is a function of the feedback current.

It is an advantage of the conversion of the output voltage into a feedback current and of the conversion of the feedback current into a control voltage, that the control voltage can be generated with a high gain and can be applied with low impedance to the control terminal of the output transistor. This leads to a high stability of the voltage regulation.

In an embodiment, a transimpedance amplifier generates the control voltage depending on the feedback current.

Preferably, the feedback voltage is provided by a voltage division of the output voltage. The feedback voltage may be provided at a feedback tap of a voltage divider.

In an embodiment, the feedback voltage is provided to a differential amplifier which generates the feedback current. The feedback current depends on the comparison of the feedback voltage and a reference voltage.

BRIEF DESCRIPTION OF THE DRAWINGS

The following description of figures of exemplary embodiments further illustrates and explains the invention. Devices with the same structure or with the same effect, respectively, appear with equivalent reference numerals. A description of a part of a circuit or a device having the same function in different figures might not be repeated in each of the following figures.

DETAILED DESCRIPTION OF THE DRAWINGS

Figure 1A:
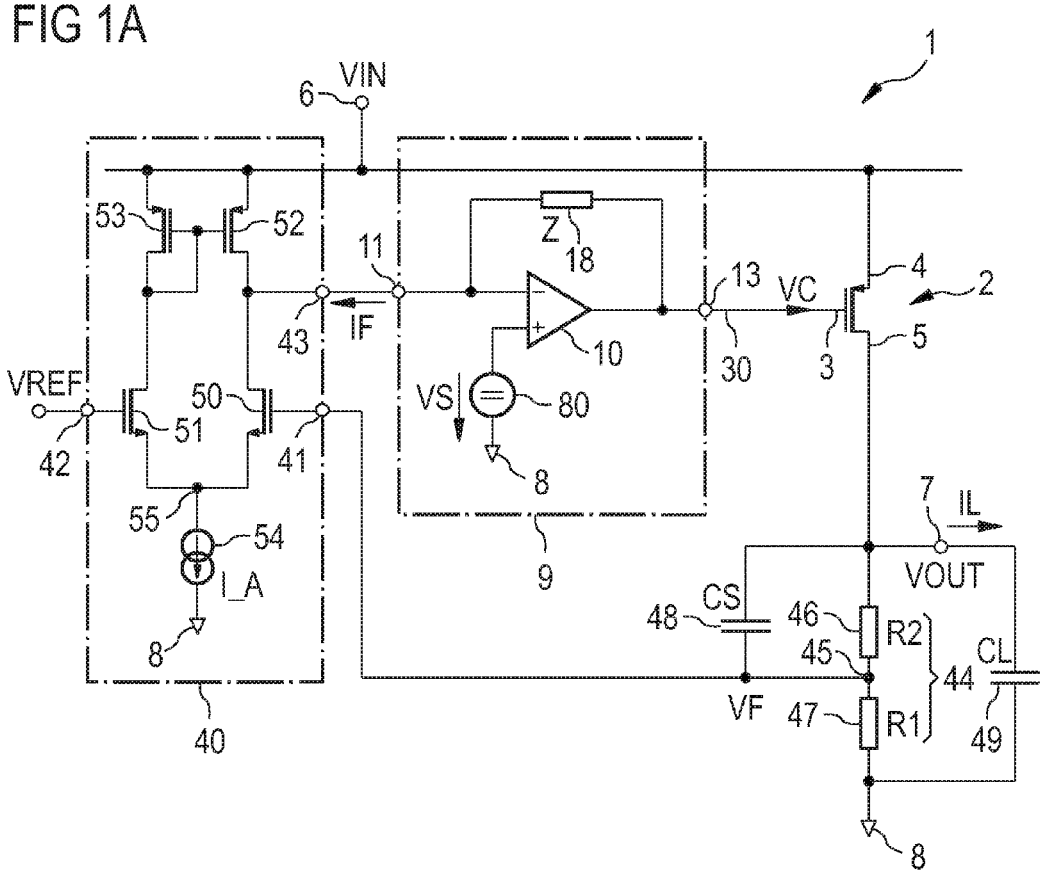
FIGS. 1A and 1B show exemplary embodiments of a voltage regulator according to the invention.

FIG. 1A shows an exemplary embodiment of a voltage regulator according to the invention. The voltage regulator 1 comprises an output transistor 2, an input terminal 6, an output terminal 7 and a transimpedance amplifier 9. The output transistor 2 comprises a control terminal 3, a first terminal 4 and a second terminal 5. The first terminal 4 of the output transistor 2 is connected to the input terminal 6. The second terminal 5 of the output transistor 2 is connected to the output terminal 7. The transimpedance amplifier 9 comprises an input terminal 11 and an output terminal 13 which is connected to the control terminal 3 of the output transistor 2. The voltage regulator 1 comprises a connection line 30 which directly connects the output terminal 13 to the control terminal 3. The transimpedance amplifier 9 comprises an amplifier 10 and a first impedance 18. The amplifier 10 comprises an input terminal which is connected to the input terminal 11 of the transimpedance amplifier 9 and an output terminal which is connected to the output terminal 13 of the transimpedance amplifier 9. The connection line 30 directly connects the output terminal of the amplifier 10 to the control terminal 3. Thus a gain factor of the coupling between the output terminal 13 of the transimpedance amplifier 9 and the control terminal 3 of the output transistor 2 is equal to a value 1, wherein the value 1 of the gain factor corresponds to 0 dB. The first impedance 18 is arranged between the input terminal of the amplifier 10 and the output terminal of the amplifier 10. The amplifier 10 comprises a further input terminal which is connected to a voltage source 80. The input terminal of the amplifier 10 is realized as an inverting input terminal. The further input terminal of the amplifier 10 is designed as a non-inverting input terminal.

FIG. 1A shows an exemplary embodiment of a voltage regulator according to the presented principle. The voltage regulator 1 comprises an output transistor 2, an input terminal 6, an output terminal 7 and a transimpedance amplifier 9. The output transistor 2 comprises a control terminal 3, a first terminal 4 and a second terminal 5. The first terminal 4 of the output transistor 2 is connected to the input terminal 6. The second terminal 5 of the output transistor 2 is connected to the output terminal 7. The transimpedance amplifier 9 comprises an input terminal 11 and an output terminal 13 which is connected to the control terminal 3 of the output transistor 2. The voltage regulator 1 comprises a connection line 30 which directly connects the output terminal 13 to the control terminal 3. The transimpedance amplifier 9 comprises an amplifier 10 and a first impedance 18. The amplifier 10 comprises an input terminal which is connected to the input terminal 11 of the transimpedance amplifier 9 and an output terminal which is connected to the output terminal 13 of the transimpedance amplifier 9. The connection line 30 directly connects the output terminal of the amplifier 10 to the control terminal 3. Thus a gain factor of the coupling between the output terminal 13 of the transimpedance amplifier 9 and the control terminal 3 of the output transistor 2 is equal to a value 1, wherein the value 1 of the gain factor corresponds to 0 dB. The first impedance 18 is arranged between the input terminal of the amplifier 10 and the output terminal of the amplifier 10. The amplifier 10 comprises a further input terminal which is connected to a voltage source 80. The input terminal of the amplifier 10 is realized as an inverting input terminal. The further input terminal of the amplifier 10 is designed as a non-inverting input terminal.

The voltage regulator 1 further comprises a differential amplifier 40 and a voltage divider 44. The differential amplifier 40 comprises a first input terminal 41, a second input terminal 42 and an output terminal 43. The output terminal 43 of the differential amplifier 40 is connected to the input terminal 11 of the transimpedance amplifier 9. The voltage divider 44 is arranged between the output terminal 7 and a reference potential terminal 8. The voltage divider 44 comprises a first divider resistor 46 and a second divider resistor 47. A feedback tap 45 is arranged between the first divider resistor 46 and the second divider resistor 47. A coupling capacitor 48 is disposed between the output terminal 7 and the feedback tap 45. The feedback tap 45 is connected to the first input terminal 41 of the differential amplifier 40. The differential amplifier 40 comprises a first, a second, a third and a fourth amplifier transistor 50 to 53 and an amplifier current source 54. A first terminal of the first amplifier transistor 50 and a first terminal of the second amplifier transistor 51 are connected together and are connected to a circuit node 55. The amplifier current source 54 is arranged between the circuit node 55 and the reference potential terminal 8. A first branch of the differential amplifier 40 comprises the third amplifier transistor 52, the first amplifier transistor 50 and the amplifier current source 54, while a second branch of the differential amplifier comprises the fourth amplifier transistor 53, the second amplifier transistor 51 and the amplifier current source 54. The first and the third amplifier transistor 50, 52 are arranged in series. Similarly, the second and the fourth amplifier transistor 51, 53 are also connected in series. A first terminal of the third amplifier transistor 52 and a first terminal of the fourth amplifier transistor 53 are connected to the input terminal 6. A control terminal of the third amplifier transistor 52 and a control terminal of the fourth amplifier transistor 53 are connected to each other and to a second terminal of the fourth amplifier transistor 53, as the third and the fourth amplifier transistors 52, 53 are arranged in the form of a current mirror. A control terminal of the first amplifier transistor 50 is connected, via the first input terminal 41 of the differential amplifier 40, to the feedback tap 45. A control terminal of the second amplifier transistor 51 is connected to the second input terminal 42 of the differential amplifier 40. A node between the first and the third amplifier transistors 50, 52 is connected to the output terminal 43 of the differential amplifier 40. A load capacitor 49 is coupled between the output terminal 7 and the reference potential terminal 8.

An input voltage VIN is supplied to the input terminal 6. The output transistor 2 provides an output voltage VOUT to the output terminal 7 as a function of a control voltage VC which is applied to the control terminal 3 of the output transistor 2. A feedback voltage VF is generated using the output voltage VOUT by the means of the voltage divider 44 and the coupling capacitor 48. The feedback voltage VF is provided via the first input terminal 41 of the differential amplifier 40 to the control terminal of the first amplifier transistor 50. A reference voltage VREF is applied to the second input terminal 42 of the differential amplifier 40 and, therefore, also to the control terminal of the second amplifier transistor 51. Under steady state conditions the feedback voltage VF can be approximately calculated according to the following equation:

$$VF = \frac{R1}{R1 + R2} \cdot VOUT \text{ and } VF = VREF,$$

wherein VF is the feedback voltage, R2 a resistance value of the first divider resistor 46, R1 a resistance value of the second divider resistor 47, VOUT the output voltage and VREF the reference voltage.

The differential amplifier 40 provides a feedback current IF to the input terminal 11 of the transimpedance amplifier 9 via the output terminal 43. A positive current flows from the input terminal 11 of the transimpedance amplifier 9 to the output terminal 43 of the differential amplifier. Using the transimpedance amplifier 9 and the connection line 30 the feedback current IF is converted into a control voltage VC which is applied to the control terminal 3 of the output transistor 2. If the output voltage VOUT increases, the feedback voltage VF and also the current through the first amplifier transistor 50 rise. As a consequence, the feedback current IF also increases. The control voltage VC can be approximately calculated according to the following equation:

$$VC = Z \cdot IF,$$

wherein VC is the control voltage, Z is the impedance value of the first impedance 18 and IF is the feedback current. A base voltage VS is provided to the further input terminal of the amplifier 10 by the voltage source 80. With the increase of the feedback current IF, the control voltage VC also rises. Therefore, a load current IL through the output transistor 2 and the output voltage VOUT decrease.

The voltage divider 44, the differential amplifier 40 and the transimpedance amplifier 9 provide a feedback loop for the output transistor 2. The loop gain-bandwidth product GBW is approximately given by the following equation:

$$GBW = GMPOUT \cdot GDA \cdot ZTA \cdot \frac{R1}{R1 + R2} \cdot \frac{1}{CL},$$

wherein GMPOUT is the transconductance of the output transistor 2, GDA the transconductance of the first amplifier transistor 50 of the differential amplifier 40, ZTA the value of the first impedance 18 of the transimpedance amplifier 9, R2 the resistance value of the first divider resistor 46, R1 the resistance value of the second divider resistor 47 and CL the capacitance value of the load capacitor 49. The accuracy is approximately given by the following equation:

$$\frac{\Delta VOUT}{\Delta IL} = \frac{1}{CL \cdot GBW},$$

wherein ΔVOUT is the change of the output voltage, AIL the change of the load current, GBW the loop gain-bandwidth product and CL the capacitance value of the load capacitor 49.

It is an advantage of the voltage regulator, that the impedance at the control terminal 3 of the output transistor 2 is limited to 1/GMP, wherein GMP is the transconductance of the amplifier 10 in the transimpedance amplifier 9.

Therefore, the associated pole stays at a sufficiently high frequency so that a good phase margin is achieved.

In case the voltage source 80 is drawn to the input voltage VIN, a voltage at the second terminal of the first amplifier transistor 50 and a voltage at the second terminal of the second amplifier transistor 51 both track the input voltage VIN in the same way. Therefore, variations in the input voltage VIN can be treated as common mode contributions and have a negligible influence on the performance of the voltage regulator 1. Furthermore, a good power-supply rejection ratio and a good line regulation are achieved.

In an alternative embodiment, the first impedance 18 is realized as a resistor.

In an embodiment, the load capacitance 49 has a high value which advantageously increases the stability of the voltage regulator 1. It also improves a transient immunity to variations of the load current IL and to noise in the input voltage VIN.

The dominant pole of the voltage regulator can be at the output terminal 7. A parasitic pole in the loop is located at the control terminal 3 of the output transistor 2 and obtains a high frequency.

It is an advantage of the voltage regulator 1 that it comprises only a small number of branches and, therefore, minimizes the overall current consumption of the voltage regulator 1.

Figure 1B:
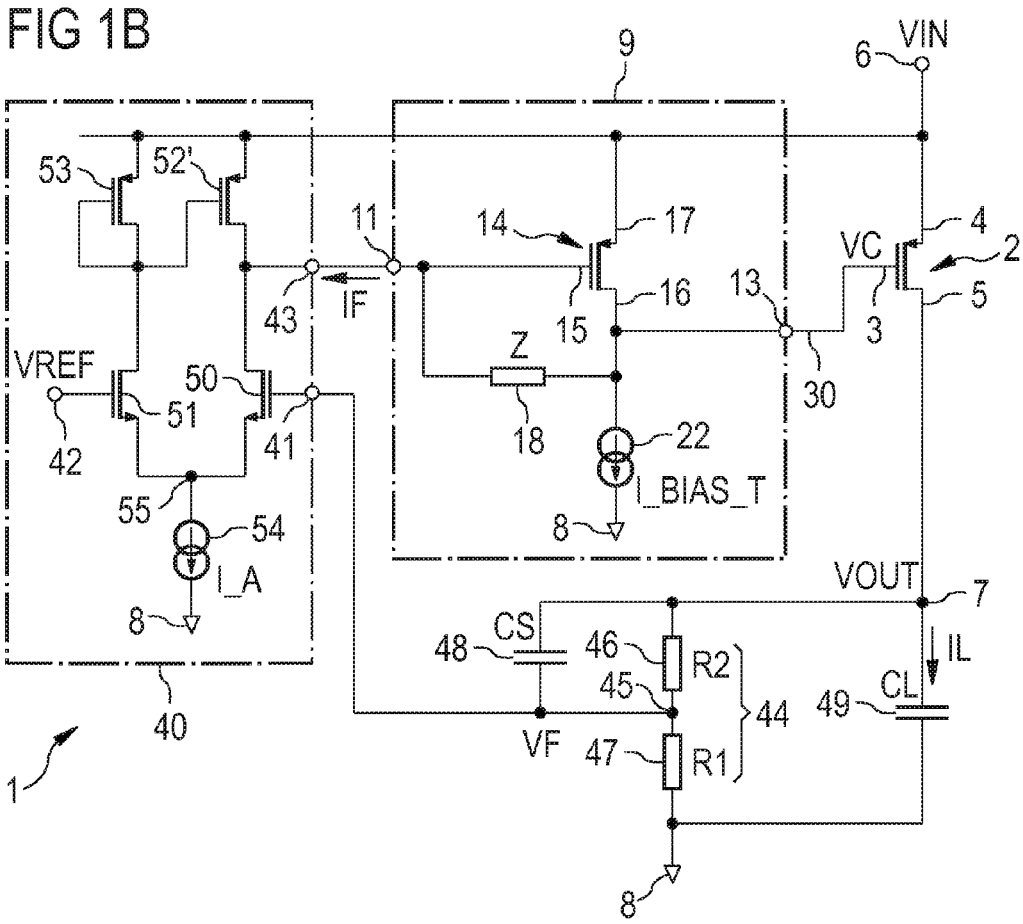

FIG. 1B shows an exemplary embodiment of a voltage regulator, which is a further development of the voltage generator shown in FIG. 1A. According to FIG. 1B the transimpedance amplifier 9 comprises a first transistor 14 with a control terminal 15, a first terminal 16 and a second terminal 17. The control terminal 15 is connected to the input terminal 11 of the transimpedance amplifier 9. The second terminal 17 of the first transistor 14 is connected to the input terminal 6. The first terminal 16 of the first transistor 14 is connected to the output terminal 13 of the transimpedance amplifier 9. Therefore, the first terminal 16 of the first transistor 14 is directly connected to the control terminal 3 of the output transistor 2 via the connection line 30. The first terminal 16 of the first transistor 14 is permanently connected to the control terminal 3 of the output transistor 2. The transimpedance amplifier 9 comprises a first current source 22 which is arranged between the first terminal 16 of the first transistor 14 and the reference potential terminal 8. The first impedance 18 couples the control terminal 15 of the first transistor 14 to the first terminal 16 of the first transistor 14. The transistors shown in FIG. 1B are metal-oxide-semiconductor field-effect transistors, abbreviated as MOSFETs. The output transistor 2, the first transistor 14, the third and the fourth amplifier transistors 52, 53 are realized as p-channel MOSFETs. The first and the second amplifier transistors 50, 51 are n-channel MOSFETs.

The feedback current IF is applied to the first impedance 18 and to the control terminal 15 of the first transistor 14. At the first terminal 16 of the first transistor 14 the control voltage VC is provided.

It is an advantage of this realization of the transimpedance amplifier 9 that only a minimum number of devices are necessary. Since the transimpedance amplifier 9 shown in FIG. 1B only comprises one current branch, the power consumption of the transimpedance amplifier 9 is low.

It is further advantageous, that the output transistor 2 and the first transistor 14 are both p-channel MOSFETs, as these transistors are matching, so that no significant offset occurs between the control terminal 3 of the output transistor 2 and the input terminal 11 of the transimpedance amplifier 9.

The impedance at the control terminal 3 of the output transistor 2 is limited to 1/GMP, wherein GMP is the transconductance of the first transistor 14. Thus the transimpedance amplifier 9 of FIG. 1B has an output impedance which is equal to 1/GMP. The connection line 30 has an impedance value which is smaller than the output impedance of the transimpedance amplifier 9. Therefore, the associated pole stays at a sufficiently high frequency so that a good phase margin is achieved.

It is an advantage of the transimpedance amplifier 9, that a voltage at the first terminal 16 of the first transistor 14 tracks the input voltage VIN so that no significant change at the control voltage VC occurs. This leads to a good power supply rejection ratio and a good line regulation.

In an alternative embodiment, the output transistor 2 and the first transistor 14 are realized as n-channel MOSFETs. This embodiment can be used as a negative LDO. In a negative LDO, the output voltage VOUT has a fixed value versus the input voltage VIN.

In a further development, the first current source is realized as a resistor. The resistor couples the first terminal 16 of the first transistor 14 to the reference potential terminal 8.

Figure 2A:
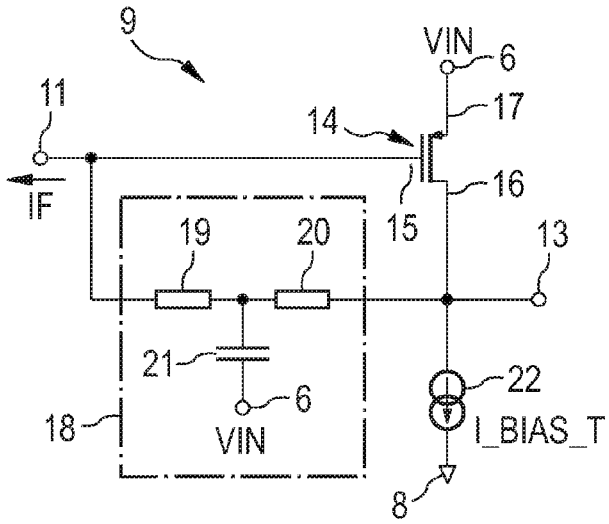
FIGS. 2A to 2C show further exemplary embodiments of a transimpedance amplifier.

FIG. 2A shows an alternative embodiment of a transimpedance amplifier. The transimpedance amplifier 9 comprises the first transistor 14, the first current source 22 and the first impedance 18. The first impedance 18 comprises a first and a second resistor 19, 20 and a first capacitor 21. The first and the second resistor 19, 20 are connected in series. The series circuit of the two resistors 19, 20 is arranged between the input terminal 11 of the transimpedance amplifier 9 and the output terminal 13 of the transimpedance amplifier 9. A node between the first resistor 19 and the second resistor 20 is coupled to the input terminal 6 via the first capacitor 21. The first impedance 18 is realized in a T-form.

It is an advantage of the first impedance 18 to improve the total loop phase margin. Therefore, the phase margin for large load conditions is improved.

Figure 2B:
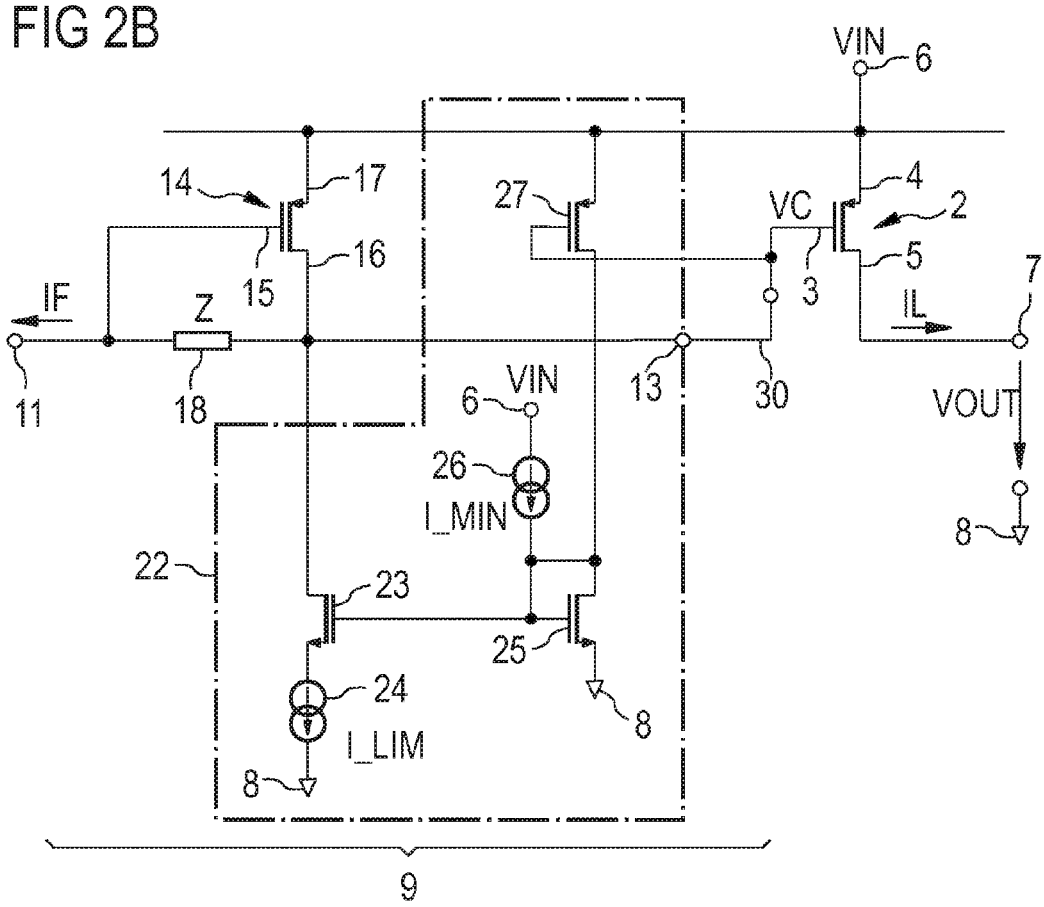

The first impedance 18 shown in FIG. 2A can also be inserted in the transimpedance amplifier shown in FIGS. 1A, 1B and 2B.

In an embodiment, the first impedance 18 is neither the dominant pole nor the second order pole of the loop, but contributes to a higher order one. Thus the stability of the voltage regulator 1 is achieved even at high tolerance values of an impedance value of the first impedance 18.

FIG. 2B shows a further embodiment of the transimpedance amplifier 9, which is a further development of the transimpedance amplifiers shown in FIGS. 1A, 1B and 2A. The transimpedance amplifier 9 shown in FIG. 2B comprises the first transistor 14, the first impedance 18 and the first current source 22. The first current source 22 is designed as a current source circuit. The first current source 22 comprises a second transistor 23 and a second current source 24. The first transistor 14, the second transistor 23 and the second current source 24 are connected in series between the input terminal 6 and the reference potential terminal 8. The controlled section of the second transistor 23 couples the first terminal 16 of the first transistor 14 to the second current source 24. The output terminal 13 of the transimpedance amplifier 9 is connected to a node between the first terminal 16 of the first transistor 14 and the controlled section of the second transistor 23.

The first current source 22 further comprises a third and a fourth transistor 25, 27 as well as a third current source 26. A controlled section of the fourth transistor 27 and the third current source 26 are connected in parallel. The parallel circuit of the fourth transistor 27 and the third current source 26 couples the input terminal 6 to a controlled section of the third transistor 25 and to a control terminal of the third transistor 25. The control terminal of the third transistor 25 is connected to a control terminal of the second transistor 23. A control terminal of the fourth transistor 27 is coupled to the control terminal 3 of the output transistor 2. Preferably, the control terminal of the fourth transistor 27 is directly connected to the control terminal 3 of the output transistor 2.

The second current source 24 provides a source current I_LIM and the third current source 26 provides a source current I_MIN. The source current I_LIM flows through the controlled section of the second transistor 23. Under steady state conditions the sum of the current flowing through the controlled section of the fourth transistor 27 and of the source current I_MIN flows through the controlled section of the third transistor 25. The circuit comprising the third and the fourth transistors 25, 27 and the third current source 26 provides a control voltage to the control terminal of the second transistor 23.

The transimpedance amplifier 9 shown in FIG. 2B comprises an adaptive bias which is achieved by the first current source 22.

It is an advantage of the second current source 24 that by the source current I_LIM the influence of a dropout condition is widely reduced.

Figure 2C:
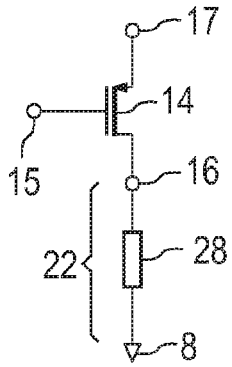

FIG. 2C shows a further embodiment of the first current source 22 which can be inserted in the transimpedance amplifiers shown in FIGS. 1B, 2A and 2B. The first current source 22 comprises a current sink resistor 28. The current sink resistor 28 couples the first terminal 16 of the first transistor 14 to the reference potential terminal 8.

Figure 3:
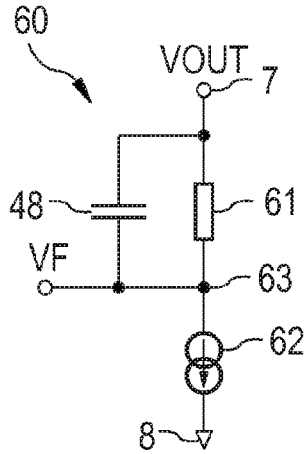
FIG. 3 shows an exemplary embodiment of a feedback circuit.

FIG. 3 shows an exemplary embodiment of a feedback circuit 60 which can be inserted instead of the voltage divider 44 in the voltage regulator shown in FIGS. 1A and 1B. The feedback circuit 60 comprises a feedback resistor 61 and a feedback current source 62 which are connected in series and are arranged between the output terminal 7 of the voltage regulator 1 and the reference potential terminal 8. The feedback circuit 60 comprises a feedback tap 63 which is arranged between the feedback resistor 61 and the feedback current source 62. The feedback tap 63 is coupled to the first input terminal 41 of the differential amplifier 40. A coupling capacitor 48 is arranged between the output terminal 7 and the feedback tap 63.

The output voltage VOUT is applied to the feedback circuit 60. The feedback current source 62 provides a current which generates an approximately constant voltage drop at the feedback resistor 61. The feedback voltage VF is provided at the feedback tap 63. The feedback voltage VF is equal to the output voltage VOUT reduced by the voltage drop at the feedback resistor 61.

Thus, the feedback circuit 60 generates the feedback voltage VF. It is an advantage that a change of the output voltage VOUT results in an approximately equal change of the feedback voltage VF because of the nearly constant voltage drop at the feedback resistor 61.

Figure 4A:
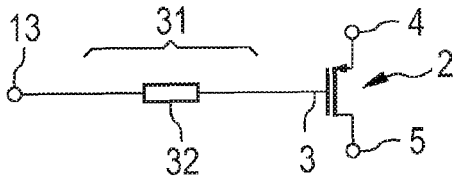
FIGS. 4A to 4E show alternative embodiments of a coupling between a transimpedance amplifier and an output transistor according to the invention.

FIG. 4A shows an alternative embodiment of a coupling of the transimpedance amplifier 9 to the output transistor 2 according to the invention. The voltage regulator 1 comprises a coupling impedance 31 which couples the output 13 of the transimpedance amplifier 9 to the control terminal 3 of the output transistor 2. The coupling impedance 31 can be realized in combination with the voltage regulator 1 shown in one of the previous figures, especially FIGS. 1A, 1B and 2B. Thus, the coupling impedance 31 couples the output of the amplifier 10 shown in FIG. 1A to the control terminal 3 of the output transistor 2. The coupling impedance 31 can also couple the first terminal 16 of the first transistor 14 shown in FIGS. 1B, 2A, 2B and 2C to the control terminal 3 of the output transistor 2. One terminal of the coupling impedance 31 is directly connected to the control terminal 3 of the output transistor 2. A further terminal of the coupling impedance 31 is directly connected to the output terminal 13 of the transimpedance amplifier 9, respectively to the output terminal of the amplifier 10 or the first terminal 16 of the first transistor 14. The coupling impedance 31 comprises an output resistor 32. Thus the output resistor 32 is directly connected at one terminal to the control terminal 3 of the output transistor 2 and at another terminal to the output terminal 13 of the transimpedance amplifier 9.

Thus, the coupling impedance 31 has an impedance value which is equal to the resistance value of the output resistor 32 and is frequency-independent. The output resistor 32 provides a resistive path between the output terminal 13 of the transimpedance amplifier 9 and the control terminal 3 of the output transistor 2. The coupling impedance 31 is realized in such a way that the impedance value of the coupling impedance 31 is smaller or equal than the impedance value of the output impedance of the transimpedance amplifier 9. Therefore, the output transistor 2 can be controlled by the transimpedance amplifier 9 with high efficiency.

In one embodiment, the impedance value of the coupling impedance 31 is given by or comprises the parasitic impedance of the connection line 30.

Figure 4B:
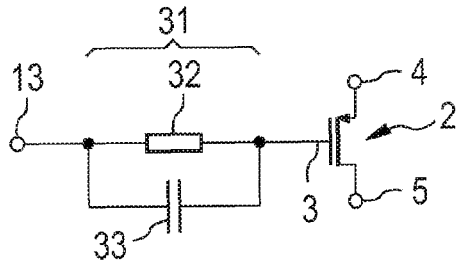

FIG. 4B shows an alternative embodiment of the coupling of the transimpedance amplifier 9 to the output transistor 2 according to the invention. In addition to the output resistor 32 shown in FIG. 4A, the coupling impedance 31 comprises an output capacitor 33 which is connected in parallel to the output resistor 32.

Thus the coupling impedance 31 has an impedance value at high frequency which is small and therefore smaller than an impedance value of the output impedance of the transimpedance amplifier 9.

In one embodiment the output resistor 32 can have a resistance value which is smaller than or equal to the impedance value of the output impedance of the transimpedance amplifier 9. Therefore, the impedance value of the coupling impedance 31 can be smaller or equal to the impedance value of the output impedance of the transimpedance amplifier 9 at small, medium and high frequencies.

Figure 4C:
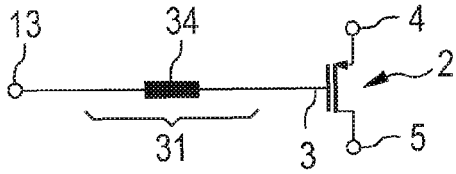

FIG. 4C shows an alternative embodiment of a coupling of a the transimpedance amplifier to the output transistor 2 according to the invention. According to FIG. 4C the coupling impedance 31 comprises an output coil 34. Thus, the impedance value of the coupling impedance 31 is smaller than the impedance value of the transimpedance amplifier 9 at low frequencies. At low frequencies, a resistive path is provided between the transimpedance amplifier 9 and the output transistor 2.

In an alternative embodiment which is not shown, the coupling impedance 31 comprises a series circuit and/or a parallel circuit of at least one output resistor 32 and/or at least one output capacitor 33 and/or at least one output coil 34. Preferably, the coupling impedance 31 comprises at least one path with a low impedance value at medium and high frequencies between the output terminal 13 of the transimpedance amplifier 9 and the control terminal 3 of the output transistor 2.

The impedance value of the coupling impedance 31 can be defined as the absolute value of the complex number of the coupling impedance 31 between the terminal and the further terminal. Thus the coupling impedance 31 has a lower or equal impedance value in comparison to the output impedance of the transimpedance amplifier 9. The impedance value of the coupling impedance 31 can preferably be determined at a frequency of 0 Hertz. If the impedance value of the coupling impedance 31 at 0 Hertz has a value smaller than infinity, than the coupling impedance 31 advantageously provides a resistive path between the output terminal 13 the transimpedance amplifier 9 and the control terminal 3 of the output transistor 2.

The coupling which is realized by the coupling impedance 31 between the output terminal 13 of the transimpedance amplifier 9 and the control terminal 3 of the output transistor 2 has a gain factor which is smaller or equal to a value 1, wherein the value 1 of the gain factor corresponds to 0 dB.

Figure 4D:
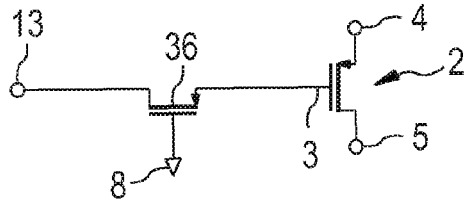

FIG. 4D shows an alternative coupling of the transimpedance amplifier 9 to the output transistor 2 according to the invention. The coupling comprises a coupling transistor 36 with a controlled section and a control terminal. A side of the controlled section of the coupling transistor 36 is directly connected to the control terminal 3 of the output transistor 2. Another side of the controlled section of the coupling transistor 36 is directly connected to the output terminal 13 of the transimpedance amplifier 9, respectively to the output terminal of the amplifier 10 or to the first terminal 16 of the first transistor 14. The coupling transistor 36 is realized as a p-channel field-effect transistor. The control terminal of the coupling transistor 36 is connected to the reference potential terminal 8. Thus, the coupling transistor 36 is in a conducting state. The coupling transistor 36 has a low resistance value of the controlled section and therefore provides a coupling with an impedance value which is smaller or equal than the impedance value of the output impedance of the transimpedance amplifier 9.

In an alternative embodiment which is not shown, the control terminal of the coupling transistor 36 is coupled via a voltage source to the reference potential terminal 8 or to the input terminal 6.

In an alternative embodiment which is not shown, the coupling transistor 36 is realized as an n-channel field-effect transistor. The control terminal of the coupling transistor 36 is connected to the input terminal 6 in this case. The control terminal of the coupling transistor 36 may alternatively be coupled via a voltage source to the input terminal 6 or to the reference potential terminal 8.

Figure 4E:
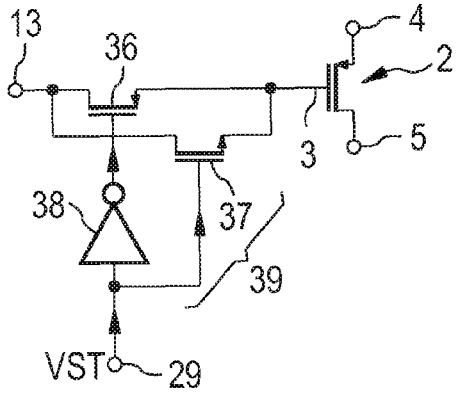

FIG. 4E shows an alternative embodiment of a coupling between the transimpedance amplifier 9 and the output transistor 2. According to FIG. 4E the coupling comprises a transmission gate 39. The transmission gate 39 comprises the coupling transistor 36 and a further coupling transistor 37. One side of the controlled section of the coupling transistor 36 and one side of the controlled section of the further coupling transistor 37 are directly connected to the control terminal 3 of the output transistor 2. Another side of the controlled section of the coupling transistor 36 and another side of the controlled section of the further coupling transistor 37 are directly connected to the output terminal 13 of the transimpedance amplifier 9 respectively to the output terminal of the amplifier 10 or to the first terminal 16 of the first transistor 14. A steering terminal 29 is connected to a control terminal of the further coupling transistor 37. The steering terminal 29 is also connected to the control terminal of the coupling transistor 36 via an inverter 38.

A steering voltage VST is provided at the steering terminal 29. The steering voltage VST is therefore applied to the control terminal of the further coupling transistor 37. An inverted voltage of the steering voltage VST is supplied to the control terminal of the coupling transistor 36. In case the steering voltage VST has a low voltage, the coupling transistor 36 and the further coupling transistor 37 are in a non-conducting state and therefore the transmission gate 39 is in a blocking state. In case the steering voltage VST has a high voltage, the further coupling transistor 37 and the coupling transistor 36 are in a conducting state leading to a transmission gate in a non-blocking state. In this case, the coupling between the transimpedance amplifier 13 and the output transistor 2 has an impedance value which is smaller or equal to an impedance value of the output impedance of the transimpedance amplifier 9.

In an alternative embodiment which is not shown, the coupling between the output terminal 13 of the transimpedance amplifier 9 and the control terminal 3 of the output transistor 2 comprises a series circuit and/or a parallel circuit of at least one of the coupling impedance 31 shown in FIGS. 4A to 4C and/or of at least one coupling transistor 36 shown in FIG. 4D and/or of the transmission gate 39 shown in FIG. 4E. Such a coupling can be described as coupling arrangement.

In an exemplary embodiment, which is not shown, the coupling arrangement comprises a first parallel circuit of the output resistor 32 and the output capacitor 33 according to FIG. 4B and a second parallel circuit of the controlled sections of the coupling transistor 36 and the further coupling transistor 37 according to FIG. 4E, wherein the first and the second parallel circuit are connected in series. A first side of the first parallel circuit is connected to the output terminal 13 of the transimpedance amplifier 9 and a second side of the first parallel circuit is connected to a first side of the second parallel circuit. A second side of the second parallel circuit is connected to the control terminal 3 of the output transistor 2. In other embodiments, the coupling arrangement comprises two devices such as impedances and/or controlled sections of coupling transistors which are connected in series. Additional impedances and/or controlled sections can be connected in series or/and in parallel.

The coupling arrangement between the output terminal 13 of the transimpedance amplifier 9 and the control terminal 3 of the output transistor 2 is designed that it obtains a gain factor which is smaller or equal to a value 1, wherein the value 1 of the gain factor corresponds to 0 dB. Further on, the coupling arrangement has an impedance value which is smaller or equal to an impedance value of the output impedance of the transimpedance amplifier 9.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A voltage regulator, comprising:

an input terminal;

an output terminal at which an output voltage is provided;

an output transistor which couples the input terminal of the voltage regulator to the output terminal of the voltage regulator; and a transimpedance amplifier including an input terminal which is coupled to the output terminal of the voltage regulator and an output terminal which is coupled to a control terminal of the output transistor via a coupling, the coupling having an impedance value between the output terminal of the transimpedance amplifier and the control terminal of the output transistor which at a given frequency is smaller than or equal to an impedance value of an output impedance of the transimpedance amplifier, wherein the transimpedance amplifier comprises an amplifier including an input terminal which is coupled to the input terminal of the transimpedance amplifier, and an output terminal which is coupled to the output terminal of the transimpedance amplifier, and wherein the transimpedance amplifier further comprises a first impedance which couples the output terminal of the transimpedance amplifier to the input terminal of the transimpedance amplifier and which comprises a first resistor with a first terminal which is connected to a first terminal of the first impedance, a second resistor with a first terminal which is connected to a second terminal of the first resistor and a second terminal which is connected to the second terminal of the first impedance and a first capacitor which couples the second terminal of the first resistor to the input terminal of the voltage regulator.

2. The voltage regulator according to claim 1, wherein the first impedance comprises a combination of resistive-capacitive elements.

3. The voltage regulator according to claim 1, wherein the amplifier comprises a first transistor having a control terminal which is coupled to the input terminal of the transimpedance amplifier, and a first terminal which is coupled to the output terminal of the transimpedance amplifier.

4. The voltage regulator according to claim 3, wherein the output transistor and the first transistor are metal-oxide-semiconductor field-effect transistors, respectively.

5. The voltage regulator according to claim 3, wherein the first terminal of the first transistor is coupled to a reference potential terminal via a first current source or a current sink resistor, and a second terminal of the first transistor is coupled to the input terminal of the voltage regulator.

6. The voltage regulator according to claim 5, wherein the first current source comprises:

a second transistor with a first terminal which is coupled the reference potential terminal via a second current source and with a second terminal which is coupled to the first terminal of the first transistor;

the second current source;

a third transistor with a control terminal which is coupled to a control terminal of the second transistor and a first terminal which is coupled to the reference potential terminal;

a third current source which couples the input terminal of the voltage regulator to the control terminal of the third transistor; and a fourth transistor with a control terminal which is coupled to the output terminal of the transimpedance amplifier, with a first terminal which is coupled to the input terminal of the voltage regulator and with a second terminal which is coupled to the second terminal of the third transistor.

7. The voltage regulator according to claim 1, comprising:

a differential amplifier including a first input terminal which is coupled to the output terminal of the voltage regulator;

a second input terminal to which a reference voltage is applied to, and an output terminal which is coupled to the input terminal of the transimpedance amplifier.

8. The voltage regulator according to claim 7, wherein the differential amplifier comprises:

a first amplifier transistor with a control terminal which is coupled to the first input terminal of the differential amplifier;

a second amplifier transistor with a control terminal which is coupled to the second input terminal of the differential amplifier;

a circuit node which is connected to a first terminal of the first amplifier transistor and to a first terminal of the second amplifier transistor; and an amplifier current source which couples the circuit node to a reference potential terminal;

wherein a second terminal of the first amplifier transistor is coupled to the output terminal of the differential amplifier.

9. The voltage regulator according to claim 8, wherein the differential amplifier comprises a current mirror which couples a second terminal of the first amplifier transistor and a second terminal of the second amplifier transistor to the input terminal.

10. The voltage regulator according to claim 7, comprising a voltage divider which couples the output terminal of the voltage regulator to a reference potential terminal and which comprises a feedback tap which is coupled to the first input terminal of the differential amplifier.

11. The voltage regulator according to claim 7, comprising a feedback circuit which comprises:

a feedback resistor and a feedback current source which are connected between the output terminal of the voltage regulator and a reference potential terminal; and a feedback tap which is arranged between the feedback resistor and the feedback current source and is coupled to the first input terminal of the differential amplifier.

12. The voltage regulator according to claim 10, comprising:

a coupling capacitor which couples the output terminal to the feedback tap.

13. A method for voltage regulation, comprising the steps of:

supplying an input voltage to an output transistor which provides an output voltage;

providing a feedback current which depends on the output voltage; and providing a control voltage by a transimpedance amplifier depending on the feedback current, wherein the control voltage is provided to a control terminal of the output transistor via a coupling, the coupling having an impedance value between the output terminal of the transimpedance amplifier and the control terminal of the output transistor which at a given frequency is smaller than or equal to an impedance value of the output impedance of the transimpedance amplifier, and wherein the feedback current is provided to the input terminal of the transimpedance amplifier, wherein the transimpedance amplifier comprises:

an amplifier with an input terminal that is coupled to the input terminal of the transimpedance amplifier and with an output terminal that is coupled to the output terminal of the transimpedance amplifier, and a first impedance which couples the output terminal of the transimpedance amplifier to the input terminal of the transimpedance amplifier and which comprises a first and a second resistor that are connected in series between the input terminal and the output terminal of the transimpedance amplifier, and a first capacitor, wherein a node between the first resistor and the second resistor is coupled to the input terminal via the first capacitor.

14. A voltage regulator, comprising:

an input terminal;

an output terminal at which an output voltage is provided;

an output transistor which couples the input terminal of the voltage regulator to the output terminal of the voltage regulator; and a transimpedance amplifier including an input terminal which is coupled to the output terminal of the voltage regulator and an output terminal which is coupled to a control terminal of the output transistor, wherein the transimpedance amplifier comprises an amplifier including an input terminal which is coupled to the input terminal of the transimpedance amplifier, and an output terminal which is coupled to the output terminal of the transimpedance amplifier, and wherein the transimpedance amplifier further comprises a first impedance which couples the output terminal of the transimpedance amplifier to the input terminal of the transimpedance amplifier and which comprises a first resistor with a first terminal which is connected to a first terminal of the first impedance, a second resistor with a first terminal which is connected to a second terminal of the first resistor and a second terminal which is connected to the second terminal of the first impedance and a first capacitor which couples the second terminal of the first resistor to the input terminal of the voltage regulator.

* * * * *